US007524136B2

(12) United States Patent
Stenger

(10) Patent No.: US 7,524,136 B2
(45) Date of Patent: Apr. 28, 2009

(54) METHOD AND COMPOSITION FOR ENHANCING THE INSULATING PROPERTIES OF A TRAFFICKED SURFACE

(76) Inventor: Earl M. Stenger, 24 Donore Sq., San Antonio, TX (US) 78229

( * ) Notice: Subject to any disclaimer, the term of this patent is extended or adjusted under 35 U.S.C. 154(b) by 125 days.

(21) Appl. No.: 11/264,875

(22) Filed: Nov. 2, 2005

(65) Prior Publication Data

US 2007/0098495 A1 May 3, 2007

(51) Int. Cl.
*E01C 3/06* (2006.01)
*E01C 5/00* (2006.01)
*E01C 9/00* (2006.01)

(52) U.S. Cl. ..... 404/72; 404/17; 404/34; 404/75; 14/73

(58) Field of Classification Search ..... 404/71, 404/75, 17, 34, 72; 14/74.5, 73
See application file for complete search history.

(56) References Cited

U.S. PATENT DOCUMENTS 1,371,032 A * 3/1921 Kendrick ..... 106/734
RE16,799 E * 11/1927 Burdge ..... 404/31
2,861,895 A * 11/1958 Hardman ..... 106/284.01
3,110,604 A * 11/1963 McConnaughay ..... 524/60
3,250,188 A 5/1966 Leonards
3,257,338 A * 6/1966 Sefton ..... 521/54
3,474,581 A * 10/1969 Gery ..... 52/220.3
3,577,893 A * 5/1971 Towner ..... 404/31
3,732,791 A * 5/1973 Hohwiller et al. ..... 404/31
3,804,543 A * 4/1974 Best ..... 404/28
3,906,067 A * 9/1975 Alspach ..... 264/46.5
3,986,781 A 10/1976 Condo et al.
4,181,448 A 1/1980 Crosky
4,711,813 A * 12/1987 Salyer ..... 428/402
5,007,764 A 4/1991 Pontynen
5,308,898 A * 5/1994 Dawans ..... 524/59
5,453,212 A * 9/1995 Annemaier et al. ..... 252/70
5,702,199 A * 12/1997 Fishback et al. ..... 404/17
6,825,444 B1 * 11/2004 Tuan et al. ..... 219/213
6,854,935 B2 2/2005 Andrews
2003/0012947 A1 * 1/2003 Cam ..... 428/321.5
2003/0203995 A1 * 10/2003 Wilson, Sr. ..... 524/2

FOREIGN PATENT DOCUMENTS

JP 406158608 6/1994

* cited by examiner

*Primary Examiner*—Raymond W Addie
(74) *Attorney, Agent, or Firm*—Akin Gump Strauss Hauer & Feld LLP

(57) ABSTRACT

A method and composition of matter used to reduce icing of roads, bridges, and overpasses where the wearing course of the paved structure contains expanded plastic polymer. The expanded plastic polymer functions as insulation and reduces the likelihood that the wearing course of the structure will freeze over, thereby lessening the danger drivers face during colder months.

29 Claims, 1 Drawing Sheet

METHOD AND COMPOSITION FOR ENHANCING THE INSULATING PROPERTIES OF A TRAFFICKED SURFACE

BACKGROUND OF THE INVENTION

This invention relates generally to a composition and method for insulating roadways to prevent icing and, more particularly, to a method for incorporating foam plastic pellets into the final surface layer, or wearing course, of a paved road.

It is well known that roads, bridges, expressways, and overpasses can ice over in periods of low temperature, resulting in unsafe driving conditions. Bridges and overpasses are particularly susceptible to this problem because they have a higher content of cold-conducting metal in their structures and more of their surface area is exposed to wind and low temperatures than that of typical roadways. The tendency of bridges and overpasses to ice over earlier than the approach pavement can result in severe accidents when unsuspecting motorists encounter an iced-over bridge after traveling on a relatively safe roadway.

Numerous methods have been employed in an attempt to reduce the danger created by this phenomenon. Some methods, such as the application of salt or sand to a roadway, are implemented shortly before or after the structure freezes in an attempt to melt the ice that forms, or to provide better traction for vehicles driving on the ice. The application of sand and deicing materials, such as salt, typically transpires after icing has occurred, which is often too late for the first motorists to drive on the roadway. In addition, the necessity of repeated applications and the corrosive effect many of these materials have on the road surface result in high maintenance costs. Furthermore, these materials can be harmful to drivers and their vehicles. The materials often cause the formation of rust on vehicles, reducing their value, and the presence of loose debris on the roadway is dangerous to pedestrians and passengers, as well as harmful to the vehicles themselves.

Other attempts at a solution focus on prevention through construction of a roadway less susceptible to icing. For example, road builders have been known to apply thick layers of gravel or other non-frost susceptible materials as a base course prior to laying down the surface pavement. The gravel layers are designed to serve as a frost barrier. The disadvantage of this method is that thick layers of the material are required to achieve the desired effect. This results in very high material, transport, and labor costs. Furthermore, it is not always feasible to lay thick layers of gravel down on bridges and overpasses.

Builders have also been known to add a layer of high-grade insulating material, such as boards of plastic foam or cork, prior to applying the surface layer of the road. The foam insulation is superior to gravel because a thinner layer of material can provide the same insulative effect. Foam plastic—created from any suitable expanded plastic polymer, such as polystyrene, polyethylene, or polyurethane—is comprised of about 5% plastic polymer and 95% air. Because air is an excellent insulator, a structure containing a sufficient amount of foam plastic will be less likely to freeze. Plastic foam's quality as an insulator is well known and can be seen in coffee cups, coolers, packaging materials, and wall insulation. However, when boards of plastic foam or other high-grade insulating material are used to form an insulative sub-layer, the material is fragile and difficult to work with. Typically, an additional layer of sand must be applied on top of the insulation material prior to the use of heavy road construction equipment or the fragile material will be crushed. The need to apply an additional layer of sand as well as the difficulty inherent in transporting and installing such lightweight and fragile material make this an undesirable method.

A third method of road construction disclosed in the prior art involves the use of an insulating sub-layer comprised of foam plastic particles dispersed throughout cement. According to this method, an additional layer of traditional asphalt or concrete is applied on top of the insulating layer to serve as the wearing course. This method has the disadvantage of requiring the application of a final surface layer of concrete on top of the insulating layer of concrete. This leads to increased labor costs because road builders must create at least two different concrete mixtures and are required to apply multiple layers.

While previous methods for insulating roadways have included layers of insulating material below the surface pavement, none have disclosed incorporating insulation material into the wearing course of a finished roadway. This is likely due to concerns about the insulating material's effect on the strength and durability of the surface pavement. However, in addition to reducing the likelihood of icing on a roadway, incorporating foam plastic into a road's wearing course rather than a sub-layer provides numerous benefits. One benefit would be lower labor costs. Because the insulating layer is the wearing course, road builders are not required to mix and spread more than one type of concrete or asphalt. A second benefit is the low cost of foam plastic itself. Foam typically costs less than the same volume of aggregate used in traditional roadways. Other benefits can be expected to arise from plastic foam's unique characteristics. For example, it is likely that a wearing course containing foam plastic will exhibit less road noise than a typical pavement and will be less impacted by environmental factors, such as extreme heat.

What is needed, therefore, is a composition and a method, which is not overly expensive or burdensome, that reduces roadway icing by incorporating insulation material into a pavement's wearing course.

BRIEF SUMMARY OF THE INVENTION

The present invention solves the foregoing problem by providing a wearing course for a paved road that includes insulative foam plastic in its structure and further providing a method for constructing said wearing course.

The wearing course in the present invention comprises an aggregate composite material, such as portland cement concrete or asphalt concrete, and a quantity of expanded plastic polymer, commonly referred to as "foam plastic," which functions as insulation. The insulative wearing course serves as a paved roadway's trafficked surface layer and is applied directly to a prepared subgrade or base course. The insulative wearing course may also serve as the surface layer for bridges, expressways, and overpasses by applying it directly to the deck of the structure or a prepared base course.

Despite previous concerns about the insulating material's effect on the strength and durability of the surface pavement, by following the method taught in the present invention, no change is expected in the durability of the roadway's wearing course. This is due to the inherent strength of confined air as well as the energy absorption characteristics of plastic foam.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. The same reference numerals are employed to designate like parts in both Figures.

In the drawings.

DETAILED DESCRIPTION OF PREFERRED EMBODIMENTS

Figure 1:
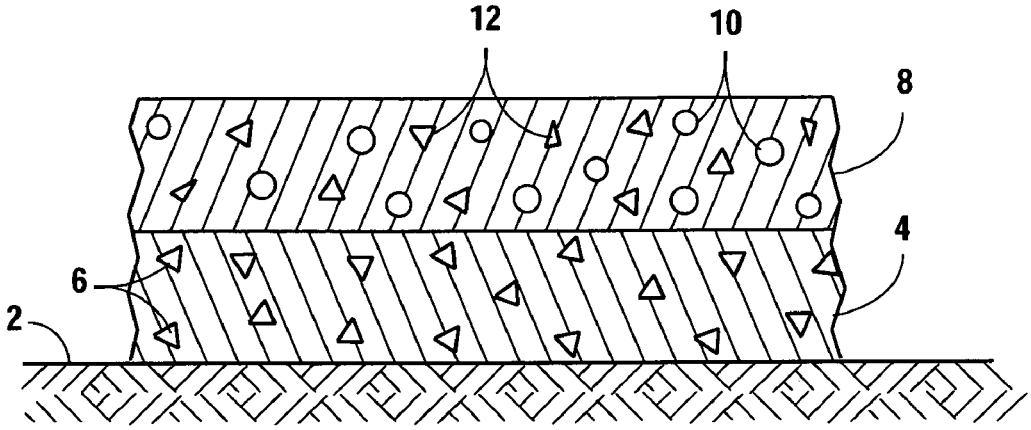
FIG. 1 shows a cross-sectional elevation view of a roadway pavement constructed according to one embodiment of the present invention.

FIG. 1 shows one embodiment of the present invention. The ground is leveled and compacted to form a suitable subgrade 2 according to techniques well known in the art. A base course 4, preferably comprised of larger-grade mineral aggregate 6, is spread and compacted on top of the subgrade 2. Alternatively, the base course 4 may be omitted. An insulative wearing course 8 of aggregate composite material, described in more detail below, is fabricated and applied as a final pavement layer.

The insulative wearing course 8 employs expanded plastic polymer pellets 10 as insulation. In one embodiment, the foam plastic pellets 10 are roughly spherical with a diameter of approximately ¼ inch and are made of polystyrene foam. Polystyrene is preferred because it is inexpensive and widely available. Spherical pellets are preferred because a sphere provides the maximum amount of surface area by volume and, therefore, the most insulation for its size. Foam pellets approximately ¼ inch in diameter will generally work well because ¼ inch is a typical size for aggregate and pellets that size will integrate well with many composite material mixtures. However, the size of the foam pellets may vary and may depend upon such factors as the type of roadway being constructed, as well as the size and quantity of other aggregate added to the composite material mixture.

The insulative wearing course 8 may be in the form of one of numerous types of pavements. One embodiment of the insulative wearing course 8 is an asphalt concrete pavement. Foam plastic pellets 10 are added to a mixture of mineral aggregate 12 and bituminous binder in an amount approximately equal to 25% to 30% of the total volume of the mixture. The amount and quality of mineral aggregate 12 added will vary depending on the particular circumstances, and a road builder with ordinary skill in the art will be able to determine the qualities best suited for obtaining a homogenous mixture. Preferably the mixture is added to the hopper of a hot mix asphalt paving machine. The asphalt concrete mixture is then applied to the desired substrate, either a base course 4, a prepared subgrade 2 as in FIG. 1, or a deck 26 as in FIG. 2. The asphalt concrete mixture may be applied using the asphalt paving machine and compressed with a roller in a manner familiar to those skilled in the art. Alternatively, a mixture of the foam plastic pellets 10 and mineral aggregate 12 is applied directly to the structure. The bituminous binder may then be applied on top of the aggregate and compressed with a roller.

A second embodiment of the insulative wearing course 8 is a cement concrete pavement. Foam plastic pellets 10 are added to a mixture of mineral aggregate 12 and portland cement binder in an amount approximately equal to 25% to 30% of the total volume of the mixture. Alternatively, the foam plastic pellets 10 may be added to the drum of a concrete mixer truck containing a cement concrete mixture. Adding the foam plastic pellets 10 to the aggregate composite material mixture prior to pouring the pavement is not essential, but it is preferred, as loose plastic foam pellets may be difficult to work with in inclement weather. As with an asphalt concrete pavement, the amount and quality of mineral aggregate 12 added will vary depending on the particular circumstances and a road builder with ordinary skill in the art will be able to determine the qualities best suited for obtaining a homogenous mixture. The cement concrete mixture is then poured onto the desired substrate, either a base course 4, a prepared subgrade 2 as in FIG. 1, or a deck 26 as in FIG. 2. A paving machine is used to facilitate the paving process.

A third embodiment of the insulative wearing course 8 is a pavement constructed from prefabricated concrete slabs. Cement concrete is mixed according to the cement concrete pavement embodiment described above. The cement concrete mixture containing the foam plastic pellets 10 is poured into a form designed for concrete pavement slabs of dimensions well known in the art. After they have cured, the prefabricated concrete slabs are transported and applied to the desired substrate, either a base course 4, a prepared subgrade 2 as in FIG. 1, or a deck 26 as in FIG. 2.

Figure 2:
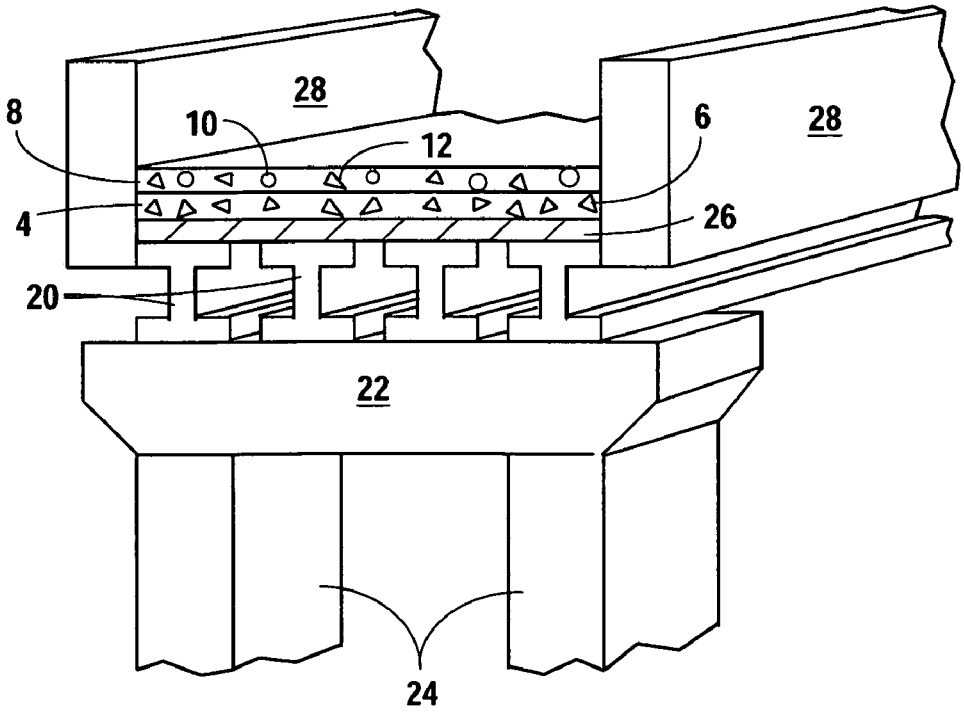
FIG. 2 shows a perspective view in partial cross-section of a bridge or overpass constructed according to one embodiment of the present invention.

An alternative embodiment of the present invention is illustrated in FIG. 2. A bridge or overpass is constructed according to traditional methods well known in the art. Preferably, steel reinforced concrete girders 20 are installed longitudinally between supports 22 attached to reinforced concrete piles 24 of the desired height. The concrete girders 20 support the deck 26 of the roadway. Concrete barrier walls 28 or guard rails should run longitudinally along the structure for safety. A base course 4, preferably comprised of larger-grade mineral aggregate 6, is spread and compacted on top of the deck 26. Alternatively, the base course 4 may be omitted. As in the previous embodiment, an insulative wearing course 8, described in more detail above, is fabricated and applied as a final pavement layer.

The foregoing description of the preferred embodiments of the present invention has been presented for purposes of illustration. It is not intended to be exhaustive or to limit the invention to the precise forms disclosed. Many variations and modifications of the embodiments described herein will be apparent to one of ordinary skill in the art in light of the above description. The scope of the invention is to be defined only by the claims appended hereto.

What is claimed is:

1. A method of reducing icing of a trafficked surface during cold weather comprising:

(a) mixing a quantity of expanded plastic polymer pellets into an unset aggregate composite paving material;

(b) applying said mixture as the wearing course of a roadway.

2. A method according to claim 1 wherein the ground is leveled and compacted to form a subgrade prior to applying said wearing course.

3. A method according to claim 1 wherein a base course is applied prior to applying said wearing course.

4. A method according to claim 1 wherein said trafficked surface is a bridge or overpass and said wearing course is applied to the deck of a bridge or overpass.

5. A method according to claim 1 wherein said aggregate composite material is portland cement concrete.

6. A method according to claim 1 wherein said aggregate composite material is asphalt concrete.

7. A method according to claim 1 wherein said aggregate composite material is prefabricated concrete slabs.

8. A paving material for use as the wearing course of a trafficked surface, that prevents icing during periods of cold weather and is substantially comprised of an aggregate composite material that includes expanded plastic polymer.

9. The paving material of claim 8 wherein said expanded plastic polymer comprises 20% to 30% of the volume of said composite material.

10. The paving material of claim 8 wherein said expanded plastic polymer is substantially spherical.

11. The paving material of claim 8 wherein said expanded plastic polymer is in the form of pellets approximately ¼inch in diameter.

12. The paving material of claim 8 wherein said expanded plastic polymer is expanded polystyrene, expanded polyethylene, or expanded polyurethane.

13. The paving material of claim 8 wherein said aggregate composite material is portland cement concrete.

14. The paving material of claim 8 wherein said aggregate composite material Is asphalt concrete.

15. The paving material of claim 8 wherein said aggregate composite material is prefabricated concrete slabs.

16. A method of reducing the effects of extreme heat and cold on a trafficked surface comprising:

(a) mixing a quantity of expanded plastic polymer pellets into an unset aggregate composite paving material;

(b) applying said mixture as the wearing course of a roadway.

17. A method according to claim 16 wherein the ground is leveled and compacted to form a subgrade prior to applying said wearing course.

18. A method according to claim 16 wherein a base course is applied prior to applying said wearing course.

19. A method according to claim 16 wherein said trafficked surface is a bridge or overpass and said wearing course is applied to the deck of a bridge or overpass.

20. A method according to claim 16 wherein said aggregate composite material is portland cement concrete.

21. A method according to claim 16 wherein said aggregate composite material is asphalt concrete.

22. A method according to claim 16 wherein said aggregate composite material is prefabricated concrete slabs.

23. A method of reducing noise from vehicular movement over a trafficked surface comprising:

(a) mixing a quantity of expanded plastic polymer pellets into an unset aggregate composite paving material;

(b) applying said mixture as the wearing course of a roadway.

24. A method according to claim 23 wherein the ground is leveled and compacted to form a subgrade prior to applying said wearing course.

25. A method according to claim 23 wherein a base course is applied prior to applying said wearing course.

26. A method according to claim 23 wherein said trafficked surface is a bridge or overpass and said wearing course is applied to the deck of a bridge or overpass.

27. A method according to claim 23 wherein said aggregate composite material is portland cement concrete.

28. A method according to claim 23 wherein said aggregate composite material is asphalt concrete.

29. A method according to claim 23 wherein said aggregate composite material is prefabricated concrete slab.

* * * * *